United States Patent [19]

Günkinger et al.

[11] Patent Number: 4,905,352

[45] Date of Patent: Mar. 6, 1990

[54] TEXTILE DRAW FRAME COILER PLATE AND METHOD OF MANUFACTURING SAME

[75] Inventors: Siegfried Günkinger, Heiningen; Josef Pöpl, Rechberghausen, both of Fed. Rep. of Germany

[73] Assignee: Zinser Textilmaschinen GmbH, Fed. Rep. of Germany

[21] Appl. No.: 327,317

[22] Filed: Mar. 22, 1989

[30] Foreign Application Priority Data

Mar. 26, 1988 [DE] Fed. Rep. of Germany ..... 3810460

[51] Int. Cl.[4] ..... B65H 54/80

[52] U.S. Cl. ..... 19/159 R

[58] Field of Search ..... 19/157, 159 R; 100/82; 242/54.4; 29/DIG. 14

[56] References Cited

U.S. PATENT DOCUMENTS 2,700,797 2/1955 Robinson ..... 19/159 R
3,105,996 10/1963 Naegeli ..... 19/159 R
4,646,390 3/1987 Bothner ..... 19/159 R
4,777,701 10/1988 Mori ..... 19/159 R

FOREIGN PATENT DOCUMENTS 3407136 8/1985 Fed. Rep. of Germany .... 19/159 R

OTHER PUBLICATIONS

"Melliand Textilberichte," 3/1977, p. 183.

*Primary Examiner*—Werner H. Schroeder
*Assistant Examiner*—D. Price
*Attorney, Agent, or Firm*—Shefte, Pinckney & Sawyer

[57] ABSTRACT

A coiler plate of the type adapted for rotational disposition in association with a sliver can of a textile draw frame, wherein the coiler plate has a compression surface for contact with sliver deposited in the can and a sliver conduit through the coiler plate opening at the compression surface, may be coated with enamel over the compression surface and the interior wall surfaces defining the sliver conduit to provide a reduced coefficient of friction relative to sliver.

5 Claims, 1 Drawing Sheet

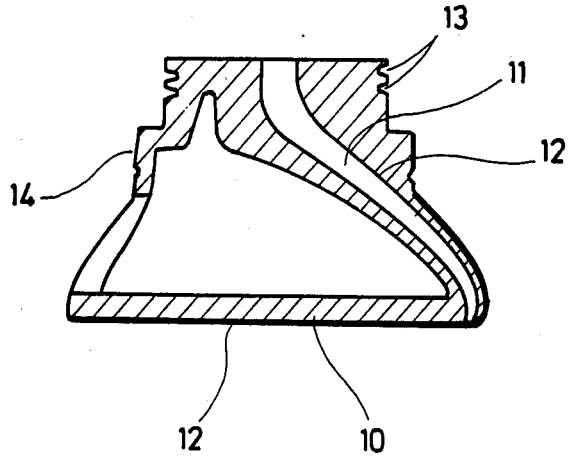
13
11
12
14
12
10

TEXTILE DRAW FRAME COILER PLATE AND METHOD OF MANUFACTURING SAME

BACKGROUND OF THE INVENTION

The present invention relates to a coiler plate of the type rotationally disposed in association with a sliver can of a textile draw frame and, more particularly, to coiler plates of the aforementioned type having a compression surface for contact with sliver deposited in the sliver can of the draw frame and a sliver conduit through the coiler plate and opening at the compression surface. The present invention also relates to a method of manufacturing a coiler plate of the aforementioned type.

In coiler plates of the aforementioned type, it is desirable to reduce as much as possible friction between the compression surface of the plate and sliver deposited beneath the plate in the associated sliver can. Various measures for accomplishing this have been proposed. For example, West German Offenlegungsschrift DE 34 07 136 discloses a coiler plate assembly wherein a coiler plate member having a compression surface is rotatably mounted in a rotatable outer cover member for rotation independently of the outer cover member. It is additionally known that the compression surface of the rotatable coiler plate may be provided with a coating in the form of a Teflon foil. While such a Teflon foil coating advantageously provides the compression surface of the coiler plate with a low coefficient of friction, such a coating has been found to have an insufficient useful life in service. It is additionally known to provide a chromed compression surface and sliver conduit, but it is necessary to grind or polish such surfaces prior to the chroming operation, which is relatively expensive.

SUMMARY OF THE INVENTION

It is accordingly an object of the present invention to provide a coiler plate of the aforementioned type with a coating on its compression surface which is simple to apply, provides a sufficiently low coefficient of friction with respect to textile sliver, and has a sufficient life in practical use.

According to the present invention, this object is obtained by providing compression surface of a coiler plate with an enamel coating, which advantageously exhibits a relatively low coefficient of friction with respect to the textile fibers comprising most slivers so that relatively low frictional forces are exerted on the sliver. Additionally, an enamel coating does not tend to become electrostatically charged, which provides additional advantges over conventional forms of coatings. Moreover, an enamel coating provides sufficient resistance to wearing to provide a desirable useful life. Another particular advantage of an enamel coating is that it may be applied relatively thickly, e.g., in the range of approximately 0.5 millimeters, which enables the provision of a relatively smooth compression surface without requiring that the underlying surface of the main body of the coiler plate be ground, polished or otherwise worked to a relatively smooth surface itself.

According to another aspect of the present invention, an enamel coating is applied to the interior wall surfaces of the coiler plate which define the sliver conduit. Preferably, a coiler plate according to the present invention is coated by immersing its compression surface and its sliver conduit in an enamel bath and subsequently baking the enamel coating to cure the enamel, which advantageously involves relatively little expense.

BRIEF DESCRIPTION OF THE DRAWING

The drawing is a schematic axial cross-sectional view of a coiler plate according to the preferred embodiment of the present invention.

DESCRIPTION OF THE PREFERRED EMBODIMENT

Referring now to the accompanying drawing, a coiler plate according to the preferred embodiment of the present invention is shown schematically in axial cross-section, the body of the coiler plate preferably being manufactured as an integral cast-metal component. A sliver conduit 11 is formed generally axially through the coiler plate from one end face thereof to the other for guiding and compressing a traveling sliver to be deposited in a sliver can of a textile draw frame (not shown). For this purpose, the sliver conduit 11 extends from an entrance location generally centrally of the upper end face of the coiler plate radially outwardly to an exit location opening adjacent the periphery of the lower end face 10 of the coiler plate, the sliver conduit 11 having a gradually decreasing cross-sectional dimension in the direction toward the lower end face 10. The lower end face 10 of the coiler plate forms a compression surface by which the coiler plate is adapted to rest on sliver deposited in the sliver can to compress the sliver. The coiler plate is adapted to rotate about a vertical shaft (not shown) and, to facilitate driven rotation, the outer periphery of the coiler plate is provided with an annular bearing surface 14 by which the plate may be supported rotatably and is also provided with annular grooves 13 by which the coiler plate may be engaged by a drive belt or belts (also not shown).

In order to minimize friction between the compression surface 10 and sliver within a sliver can on which the coiler plate may rest, the compression surface 10 is provided according to the present invention with a coating 12 of enamel. Preferably, the enamel coating 12 also extends over the entire interior wall surface defining the sliver conduit 11 of the coiler plate. The enamel coating 12 also preferably extends laterally over the peripheral edge of the compression surface 10 and covers at least partially the adjacent annular side surfaces of the coiler plate.

The enamel coating 12 is preferably applied by immersing the coiler plate in a liquid enamel bath, any areas of the coiler plate which are not desired to be coated with the enamel being covered in a suitable manner. The liquid enamel coating is subsequently cured by baking at a relatively high temperature in the range of approximately 900° Centigrade and higher. In order to achieve a desirable smoothing of the outer enamel surface, an enamel powder may be spread onto an initial layer of the liquid enamel, the powder being subsequently baked into the enamel coating to melt the powder and thereby provide a particularly smooth outer enamel surface. Use of a fine-grained enamel powder for this purpose provides particularly advantageous results.

The enamel coating 12 may be applied relatively thickly, for example, in a layer thickness of approximately 0.5 millimeters. An enamel coating of this thickness serves to cover and compensate for irregularities in the cast metal surface of the main body of the coiler plate. Accordingly, it is unnecessary to work the compression surface 10 of the main body of the coiler plate and the interior walls defining the sliver conduit 11 to a fine degree of smoothness, e.g., by grinding or polishing such surfaces, in order to achieve a desirable smoothness and low coefficient of friction of the outer surface of the enamel coating.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A coiler plate for rotational disposition in association with a sliver can of a textile draw frame, said coiler plate having a compression surface for contact with sliver deposited in the can, a sliver conduit through the coiler plate and opening at the compression surface, and an enamel coating on the compression surface for reducing friction between the compression surface and sliver deposited in the can.

2. A coiler plate according to claim 1 and characterized further in that the enamel coating extends over the surfaces of the coiler plate defining the sliver conduit.

3. A method of manufacturing a coiler plate of the type adapted for rotational disposition in association with a sliver can of a textile draw frame, comprising the steps of providing a coiler plate having a compression surface for contact with sliver deposited in the can, and coating the compression surface with enamel for reducing friction between the compression surface and sliver deposited in the can.

4. A method of manufacturing a coiler plate according to claim 3 and characterized further by forming a sliver conduit through the coiler plate and coating the surfaces of the coiler plate defining the sliver conduit with enamel.

5. A method of manufacturing a coiler plate according to claim 3 and characterized further in that the step of coating includes immersing the compression surface in an enamel bath and curing the enamel coating by baking.

* * * * *